United States Patent [19]

Mackiewicz

[11] Patent Number: 4,633,377

[45] Date of Patent: Dec. 30, 1986

[54] LIGHTING FIXTURE WITH SQUARE BEAM PATTERN

[75] Inventor: Edward T. Mackiewicz, Chicago, Ill.

[73] Assignee: Kenall Manufacturing Company, Chicago, Ill.

[21] Appl. No.: 776,680

[22] Filed: Sep. 16, 1985

[51] Int. Cl.[4] ..... F21V 5/02

[52] U.S. Cl. ..... 362/309; 362/332; 362/374; 362/408

[58] Field of Search ..... 362/296, 307, 309, 310, 362/311, 374, 329, 339, 375, 147, 408, 308, 332

[56] References Cited

U.S. PATENT DOCUMENTS

| | | | |
|---|---|---|---|
| 4,285,034 | 8/1981 | Sullivan | 362/305 |
| 4,323,954 | 4/1982 | Florence et al. | 362/311 |
| 4,462,068 | 7/1984 | Shadwick | 362/375 |

FOREIGN PATENT DOCUMENTS

| | | | |
|---|---|---|---|
| 5909 | of 1914 | United Kingdom | 362/307 |
| 351761 | 7/1931 | United Kingdom | 362/339 |

*Primary Examiner*—William A. Cuchlinski, Jr.

*Assistant Examiner*—D. M. Cox

*Attorney, Agent, or Firm*—Trexler, Bushnell & Wolters, Ltd.

[57] ABSTRACT

A light-distributing diffuser for an electrical lighting fixture. The diffuser is rectangular in transverse section and is generally in the shape of an inverted truncated pyramid having an enlarged base and a reduced, outwardly-extending end. The outwardly extending end of the truncated pyramid is surmounted by a vaulted, quadri-faceted cap. The walls of the diffuser are formed with an array of fluted, groove-like channels extending longitudinally along the side and including arrays having channels of lesser and of greater radii of transverse curvature, the arrays being disposed symmetrically with respect to a longitudinally extending center line of each side. The cap is formed on each of four side-connected triangular panels thereof with a pair of laterally-adjacent arrays of fluted channels angled to converge and to intersect along a center line of each panel and along abutting side edges of said panels, to direct illumination diagonally and to achieve an essentially rectangular beam light pattern.

25 Claims, 8 Drawing Figures

Fig. 1.
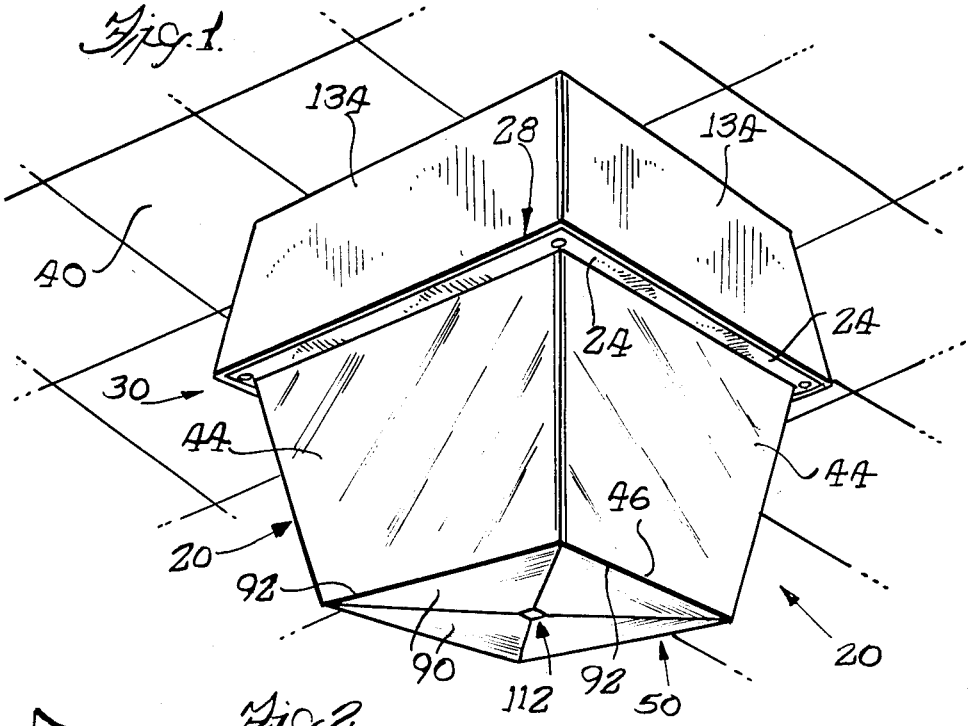
Fig. 2.
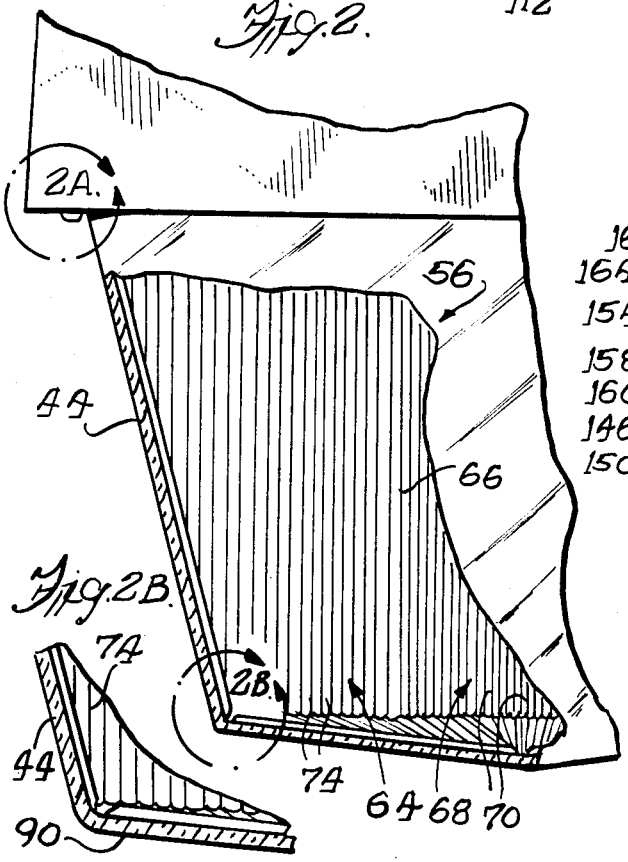
Fig. 2A.
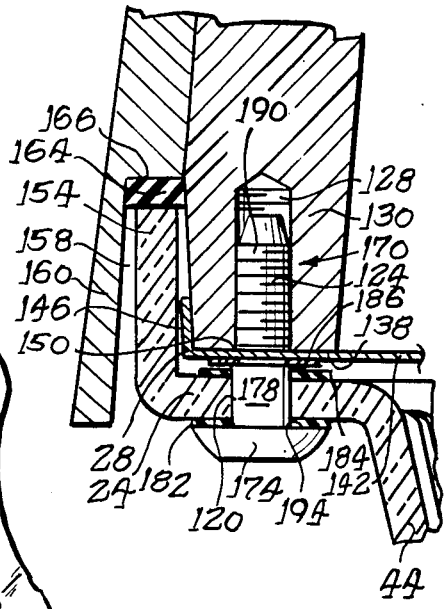
Fig. 2B.

LIGHTING FIXTURE WITH SQUARE BEAM PATTERN

BACKGROUND OF THE INVENTION

The present invention relates to a light-distributing diffuser for an electrical lighting fixture. More particularly, the invention is directed to a light-distributing diffuser for directing illumination to achieve an essentially square beam light pattern.

Reliance upon diffusers as an aid to distribute and to direct the light emanating from lighting fixtures is a well-established practice. Such diffusers have been employed with both incandescent and fluorescent light sources and have taken many and varied physical forms and configurations. Research in this area continues to be an important field of developmental engineering.

A principal goal in the research conducted in this field of investigation has been to devise light distributing diffusers which provide predetermined, selectible beam patterns. A major endeavor has been to design diffusers which generate and subtend rectangular or "squared-off" heam patterns. Such patterns make it possible for multiple fixtures, organized in an appropriate array, to serve effectively to illuminate evenly the entire field to which the lighting is directed. Notwithstanding the fact that considerable effort has been expended and considerable research has been conducted toward achieving the type of illumination described above, no completely acceptable satisfactory solution to the problems posed has been achieved. It is, accordingly, a principal aim of the present invention to obviate shortcomings of prior art light diffusers for electrical fixtures and to provide a diffuser which subtends a squared-off illumination pattern.

SUMMARY OF THE INVENTION

The present invention provides a light-distributing diffuser for attachment to a lamp housing of an electrical lighting fixture. In a preferred embodiment the diffuser is of a unitary plastic construction and is in the form of a truncated pyramid having a rectangular base, for example, a squared base, and surmounted by a vaulted, quadri-faceted cap or crown.

It is a feature of the diffuser of the invention that each of the four trapezoidal sides of the structure is formed with a fluted light-dispersing pattern, preferably on an under surface thereof.

A related feature of the invention is that the fluted pattern formed on the sidewalls of the diffuser serves to direct illumination diagonally and into the corners of a rectangle subtended by the base of the diffuser to provide a squared-off beam illumination pattern.

Yet another feature of the diffuser of the invention is that it includes an integrally formed, rim-like flange which frames the pyramidal body of the diffuser and serves to facilitate attaching the diffuser to a housing of the electrical fixture.

In a preferred embodiment of the invention the pyramidal body and the cap of the diffuser are integrally formed in the same molding operation. A related feature of the invention is that an extraordinarily high impact strength plastic such as polycarbonate is used for the diffuser itself.

It is a feature of the generally trapezoidal sidewalls or panels of the body of the diffuser that each is formed with a laterally distributed array of groove-like channels or flutes, each array being characterized by a pattern including fluted channels and alternately disposed ribs, the latter having lesser and greater radii of transverse curvature.

In a preferred embodiment of the invention the fluted zones are arranged symmetrically with respect to a center line of each of the sidewalls, the center line extending normally of a base of each of the sidewalls of the diffuser.

A related feature of a preferred embodiment of the diffuser of the invention is that the fluted zones embrace the entire planar expanse of the diffuser sides.

In a preferred embodiment of the invention the diffuser is plastic of the type which is resistive to mechanical shock, and the housing is fabricated of heat dissipative metal, for example, of die-cast aluminum or aluminum alloys.

The fixture in which the diffuser of the invention finds utility includes a reflector interposed between the diffuser and the housing to which the diffuser is attached.

Still another feature of the diffuser of the invention is a skirt integrally formed with the body and with the rim of the diffuser and depending therefrom for attaching and sealing the diffuser to the fixture housing.

A related feature of the invention is that there is provided a compressible gasket or O-ring and a shoulder of the housing for supporting the gasket to effect a seal between the housing and the skirt of the diffuser, so as to prevent moisture from the ambient system invading the fixture.

An important feature of the present invention is the particular structure by which the diffuser is secured to the housing of the fixture. In a preferred embodiment illustrated, the rim of the diffuser is formed with transverse through holes spaced peripherally therearound for accommodating a headed bolt which engages, in turn, within threaded bores formed in a bounding wall of the housing.

A related feature of the invention is that adjacent and below its head the bolt which secures the diffuser to the housing is formed with an unthreaded collar or shank having a length greater than the thickness of the mounting flange of the diffuser and having a diameter less than the holes formed in the flange but greater than the diameter of the threaded bores in the housing. The unthreaded shank serves as a spacer for preventing the bolt from impressing damaging compressive, stress-generating forces against the rim or flange of the diffuser upon attachment thereof to the housing of the fixture.

In a preferred embodiment of the invention the cap which surmounts the body of the diffuser is a vaulted dish having four generally triangular panels angularly disposed toward one another and joined to one another at abutting corresponding side edges to define a quadrifaceted end closure of the diffuser.

It is a feature of the diffuser of the invention that each panel is divided into zones separated by a center line which extends from an apex of the cap to a corresponding base edge of each panel.

A related feature of the cap of the diffuser of the invention is that each panel is formed with a dual laterally-adjacent array of fluted channels in which the channels of the arrays are angled to converge and to intersect along the center line of each panel and along the abutting side edges of adjacent panels.

Further objects, features and advantages of the invention will become apparent from the following detailed description of embodiments thereof read in conjunction with the accompanying drawings. The features of the invention believed to be novel will be more particularly pointed out in the appended claims.

BRIEF DESCRIPTION OF THE DRAWINGS

FIG. 1 is a perspective, seen from below, of a fixture of the type in which the light distributing diffuser of the invention finds utility;

FIG. 2 is an enlarged fragmentary view showing, schematically, the fluted groove-like or light dispersing channels formed in the sidewall and in the cap of the diffuser of the invention;

FIG. 2A is a greatly enlarged cross-sectional view of the zone designated as "A" in FIG. 2, and showing the manner of attachment of the diffuser and the reflector to the housing of a light fixture, according to the invention.

FIG. 2B is an enlarged fragmentary view of the zone designated as "B" in FIG. 2, and illustrating the integrally molded junction of the sidewall and the cap of the diffuser of the invention;

DESCRIPTION OF PREFERRED EMBODIMENT

Figures 3, 4, 5, 6:
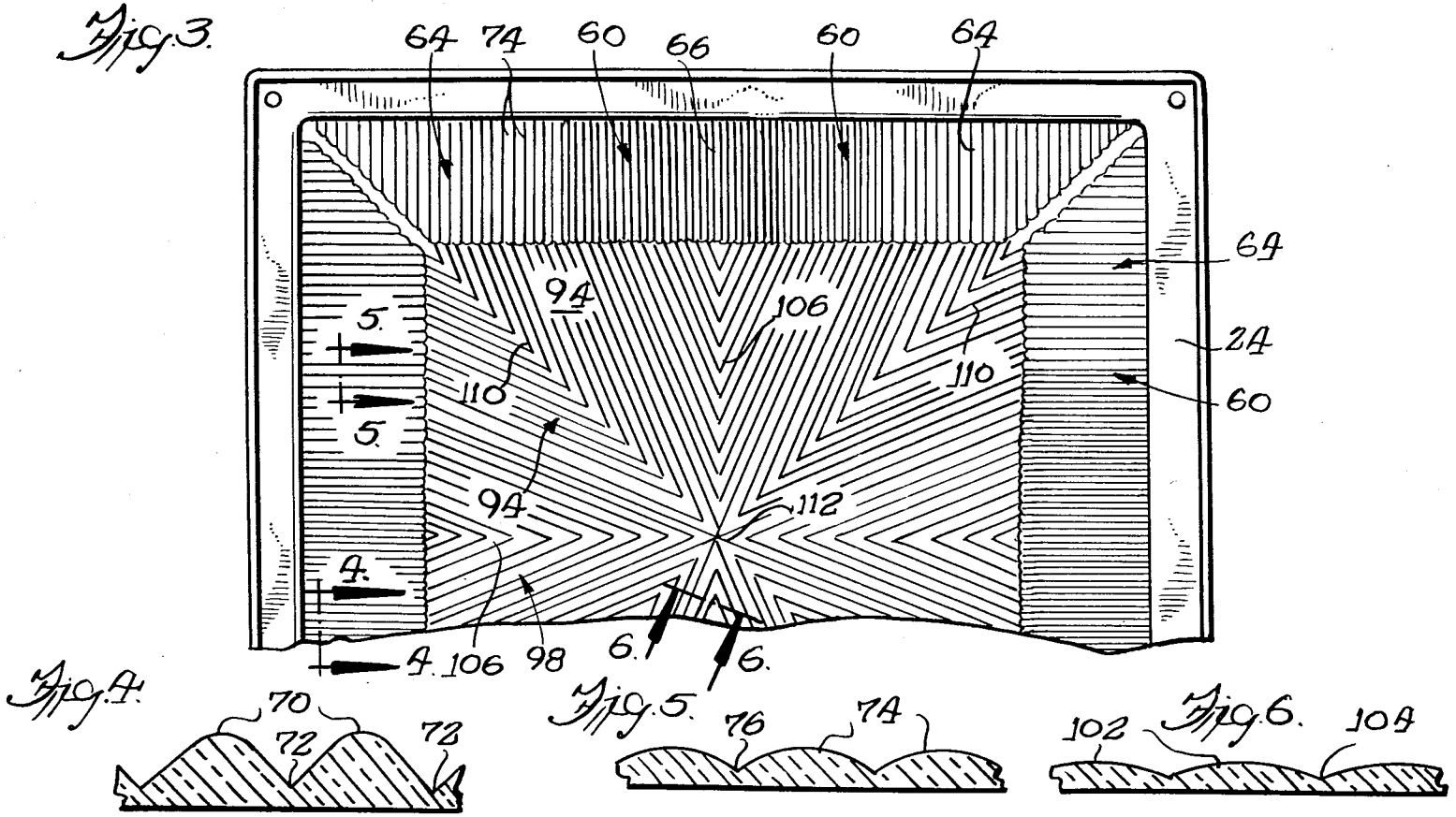
FIG. 3 is a fragmentary bottom view of the diffuser of the invention showing the sidewalls and the integrally molded surmounting cap.
FIGS. 4, 5 and 6 are, respectively, cross-sectional views taken substantially on the lines 4—4, 5—5, and 6—6 of FIG. 3, and illustrating geometrical relationships and configurations of the fluted channels and ribs of the diffuser in a preferred embodiment of the invention.

The aims and objects of the invention are accomplished by providing in a diffuser taking the form of a truncated inverted pyramid having a generally rectangular cross-sectional configuration, sidewalls which are formed with an array of fluted groove-like channels extending longitudinally along the sides and defining ribs of lesser and greater radii of transverse curvature. In a preferred embodment of the invention the arrays are disposed symmetrically with respect to a longitudinally extending center line of each side of the diffuser. The outwardly extending end of the pyramid is surmounted by a vaulted cap or crown which, in a preferred form of the invention, includes four principal panels, each panel being generally triangular and formed with a pair of laterally adjacent arrays of fluted channels angled to converge and to intersect along a center line of each panel and along abutting side edges of the panels to direct illumination diagonally and to achieve an essentially rectangular or square beam light pattern.

The goals of the invention are further effectuated by providing a diffuser mounting rim or flange and a shouldered fastener structure for securing the mounting flange to a lamp housing in a manner to prevent impressing damaging compressive stress-generating forces against the mounting flange of the diffuser. The diffuser of the invention is also provided with a skirt integrally formed with and extending from an outside edge of the rim for abutment against a shoulder of the lamp housing to establish a seal between the housing and diffuser and to prevent invasion of fluid from the ambient atmosphere into the interior cavity bounded by the diffuser and the fixture housing.

Referring now to the drawings, and more particularly to FIG. 1, there is shown one preferred embodiment of the diffuser of the invention provided for illustrative purposes and not to be construed in any limiting sense. The diffuser consists, in the embodiment illustrated, of a unitary assembly 20 preferably integrally molded of a shock resisting plastic such as a polycarbonate. In FIG. 1, the diffuser 20 is depicted as attached, at a circumscribing, laterally extending flange 24 thereof, to depend from a framing peripheral zone 28 of a lamp housing 30. The latter is, in turn, fastened to and projects downwardly from a ceiling structure 40.

The diffuser 20 shown is in the form of an inverted truncated pyramid having a polygonal base and subtended sidewalls 44 depending therefrom. In the specific example illustrated, the base is a four sided rectangle, preferably a square, and the pyramid itself is four sided. At the terminal edges 46 of its downwardly extending, converging sidewalls 44 of the truncated pyramid, the latter is surmounted by a vaulted cap or crown 50 which, in a preferred embodiment of the invention, is integrally molded with the sidewalls 44.

Each of the sidewalls 44 of the diffuser 20 is trapezoidal in shape and the walls themselves are formed on an inside or on an undersurface thereof with a ribbed and fluted molded or otherwise formed light-dispersing pattern 56 (FIG. 2), defining an array of laterally spaced, light diffusing zones 60 and 64 arranged symmetrically with respect to a vertically extending center line 66 of each sidewall 44 (FIG. 3). The light directing zones 60 and 64 define ribs or prisms 70 and flutes or channels 72, and ribs 74 and flutes 76. The ribs 70 (zone 60) are of lesser radii of transverse curvature than are the ribs 74 (zone 64), as indicated schematically in the enlarged cross-sectional views shown in FIGS. 4 and 5. The zones 60 with the ribs 70 of the lesser radii of transverse curvature are symmetrically disposed in sectors 60 on either side of the center line 66 of each sidewall 44, while the ribs 74 having the greater radii of transverse curvature occupy the sectors 64 at either lateral extremity of the sidewalls 44 so that the pattern formed on each sidewall 44 is symmetrical with respect to the vertically extending center line 66 of each sidewall 44.

In the preferred embodiment of the diffuser illustrated (FIGS. 4 and 5), the ribs 74 in the zone 64 and the ribs 70 in the zone 60 have the same periodicity or frequency, or linear repetition rates or cycle. That is, there are the same number of ribs per lineal increment. The amplitudes of the ribs 70 and 74 differ, however, and in the example of the invention shown the ribs 70 in the zone 60 have a transverse height or amplitude about twice that of the ribs 74 in the end zones 64.

In the specific preferred form of the diffuser 20 shown in the drawings, the ribs or prisms 70 and 74 each occupy 0.10 inch in lineal expanse, from prism-to-prism, the ribs extending in each case from an integrally formed base having a thickness of about 0.115 inch. The radius of curvature of the top surface of the ribs 70 and exhibiting the greater amplitude is preferably 0.025, and the prism angle is 45 degrees for a first (center zone) group of prisms and 40 degrees for a second (laterally displaced zone) group. The radius of curvature of the lesser amplitude ribs 74 varies, preferably in incremental groups arranged lineally and covering an irregularly stepped range of from about 0.087 inch to about 0.193 inch, the radius increasing in each incremental group as viewed from an inner lineal sector outwardly.

The structure including the relative amplitudes, frequency and spacial distribution pattern of the arrays of ribs or prisms contribute to and effectuate the realization of an essentially rectangular or squared-off illumination field for the diffuser of the invention.

The crown or cap 50 of the diffuser 20 is vaulted to project outwardly toward an apex of the truncated pyramid formed by the walls 44, as shown in FIGS. 1 and 2. Generally dish-shaped, the cap 50 consists of four essentially triangular panels 90 each having a base edge 92 abutting a corresponding edge 46 of a respective one of the sides 44 of the pyramidal body of the diffuser 20 to define a quadri-faceted end closure for the diffuser 20. Each panel 90 of the cap 50 is formed on an inner or central surface thereof with dual, laterally-adjacent arrays 94 and 98 of prisms 102 and channels 104, the prisms and channels in each of adjacent arrays being angled in the arrays to converge along a center line 106 of each panel 90 and along ahutting side edges 110 of adjacent panels of the cap 50 (FIG. 3). That is, each panel 90 is divided into two arrays along a center line 106 extending from an apex zone 112 of the cap 50 to a corresponding opposed base edge 92 of each panel 90, as indicated in FIG. 1.

In the preferred embodiment of the invention shown (FIGS. 3 and 6), the width of the prisms is 0.125 inch and the radius of transverse curvature is 0.125 inch, for the cap or crown. An enlarged detail of the prism and flute structure is illustrated in the cross sectional view of FIG. 6. The amplitude of the prism 102 of the cap 50 falls in a mid range of that of the prisms or ribs 74 in the lateral zone of the sidewalls 44 of the diffuser 20.

The structure by means of which the plastic, preferably polycarbonate, diffuser 20 is secured to extend from the die-cast aluminum lamp housing 30 is shown generally in FIG. 1 and more precisely in the cut-away view of FIG. 2A. The pyramidal body of the diffuser 20 is formed at its open end with a circumambient framing rim or flange 24 integral with the sidewalls 44 of the diffuser 20 and extending laterally and generally normally of an axis of the pyramid. Holes 120 in the diffuser rim 24 are in registry with cooperating threaded bores 128 projecting into a wall-like mounting boss 130 of the dish-like housing 30 and generally normally of the flange 24. The boss 130 delineates the bounding walls 134 of the housing 30 and defines the perimetric bounds of a planar end face 138 of the housing 30 at its open end.

In the specific embodiment of the invention shown, a bright-dipped light reflector sheet 142 of the lighting fixture overlies and is supported on the end face 138 of the housing 30. The reflector 142 is integrally formed with a circumscribing web 146 embracing the boss 130 of the housing 30 and in circumscribing sleeve-like engagement therearound. The reflector sheet 142 is prepunched to provide through mounting holes 150 located for registry with the holes 120 in the rim 24 of the diffuser 20 and the threaded bores 128 in the mounting boss 130, all as indicated schematically in FIG. 2A.

Referring further to FIG. 2A, the diffuser 20 is formed, at the horizontal mounting flange 24 thereof, with a circumambient skirt 154 integral with and extending generally normally of the flange 24. The skirt 154 projects into a cooperating annular, moat-like trough-shaped channel 158 bounded by the boss 130 and a perimetric base wall 160 displaced radially outwardly of the boss 130 of the housing 30 and circumscribing the skirt 154 of the diffuser 20. An O-ring type gasket 164 positioned in the channel 158 seats on a horizontal floor 166 at a closed end of the channel 158. As shown, the gasket 164 is interposed as a fluid-impervious seal between the diffuser at the end of the skirt 154 and the housing 30, at the floor 166 of the trough 158. The sealing gasket 164 renders the fixture suitable for use in wet locations.

With the reflector 142 in position on the end face 138 of the housing boss 130, the diffuser 20 in place, and the respective reflector holes 150 and housing bores 128 and diffuser holes 120 aligned, a threaded, torque-limiting screw or bolt 170 may be inserted for threaded engagement in the bore 128 of the mounting boss 130.

In a preferred embodiment of the invention, the bolt 170 has a cap-like head 174 and an enlarged, unthreaded shank 178 of an axial height which exceeds the through thickness of the diffuser mounting flange 24. Washers 182 and 184 of an asbestos-rubber composition are positioned on the shank 178 of the bolt 170 on each of opposed outer and inner surfaces of the diffuser flange 24 to cushion and insulate, and to seal against moisture. A captive disc or retaining washer 186 is rotatably secured to encircle the bolt 170 below and to abut the shank 178 at its end removed from the bolt head 174 to retain the assembly in place.

From the foregoing detailed description, considered in conjunction with the drawing (FIG. 2A), the functional intercooperation between and the method of assembly and attachment of the diffuser 20 to the lamp housing 30 will be readily understood. With the shank 178 of the threaded bolt 124 extending through the outer washer 182, the diffuser rim 24 and the inner washer 184, and the retainer 186 in position on the threaded shaft 190 at the end of the shank 178, the threaded shaft 190 of the bolt 170 is inserted through the reflector 142 and into for engagement within the threaded bore 128 of the boss 130. Simultaneously, the depending skirt 154 of the diffuser 20 enters into the channel 158 stressingly to abut in sealing engagement the O-ring gasket 164. The bolt is then tightened. The shank, in conjunction with the washer 182, establishes a predetermined, finite minimum spacing between the undersurface 194 of the bolt head 174 and the retainer disc 186 to obviate over torquing and to prevent application of objectionable and deleterious excessive pressure against the plastic diffuser flange 24 as the bolt 170 is tightened.

What is claimed is:

1. A molded plastic, light-distributing diffuser for attachment to a lamp housing of an electrical lighting fixture, said diffuser comprising an inverted truncated pyramid and a fluted multi-planar cap surmounting said pyramid at its truncated end and joined thereto along end edges thereof, said truncated pyramid having a rectangular base and a plurality of sides, each of said sides extending from and projecting inwardly of bounding perimetric base lines of said base to define at intersecting terminating end edges thereof remote from said base and at a truncated end of said pyramid a subtended rectangle having sides of lesser dimensions than corresponding sides of said base, said rectangle at said truncated end of said pyramid defining a polygon extending in a plane spaced from and paralleling said base and coaxial therewith, each of said sides being generally of a trapezoidal configuration and each being formed with a fluted light-dispersing pattern on a principal surface thereof, each said pattern comprising a plurality of spaced parallel ribs defining a laterally distributed array of groove-like channels extending normally of said base line of said base and embracing a planar expanse of each of said sides of said pyramid, said ribs being curved at outwardly projecting surfaces thereof and being arrayed in zones characterized by a pattern including ribs having lesser and greater radii of transverse curvature, said zones being arranged symmetrically with respect to a center line of each of said sides extending normally of each of said base lines of said sides, and flange means for connecting said diffuser to a lamp housing, said cap being vaulted to project outwardly toward an apex of said pyramid, and said cap including four interconnected, generally-triangular panels angularly disposed to one another to define a dish opening upwardly toward said truncated end of said pyramid, each of said panels having a base edge abutting a corresponding edge of a respective one of said sides of said truncated pyramid, and each of said panels having side edges with each of said side edges in contact with side edges of each of said panels thereadjacent to define a quadri-faceted end closure for said diffuser, each of said panels being divided along a center line extending from an apex of said cap to a corresponding base edge of each of said panels, and each of said panels being formed with dual, laterally-adjacent arrays of fluted channels, said fluted channels of said arrays being angled to converge and to intersect along said center line of each of said panels and along said side edges of adjacent said panels.

2. The diffuser as set forth in claim 1 wherein said truncated pyramid and said cap surmounting said pyramid are of a unitary structure and integrally molded in a single molding operation.

3. The diffuser as set forth in claim 1 wherein said diffuser is fabricated of a high-impact strength, shatter-proof plastic.

4. The diffuser as set forth in claim 1 wherein said fluted light-dispersing pattern on said sides of said truncated pyramid and said arrays of fluted channels of said cap diffuse, distribute, and direct illumination diagonally to achieve an essentially rectangular beam light pattern.

5. The diffuser as set forth in claim 1 and further comprising a housing for attachment of said diffuser thereto, and wherein said flange means for connecting said diffuser to said lamp housing comprises a circumambient rim framing said truncated pyramid and extending in a plane generally normally of an axis of said pyramid, said rim being formed with a plurality of through, transverse holes spaced peripherally about said rim, fastener means for securing said diffuser to said housing, said housing being formed with threaded bores extending into said housing and generally normally of said rim, said fastener means comprising an elongated shaft including a threaded section for mating within said threaded bores in said housing, a radially enlarged head surmounting said shaft, spacer means for preventing direct contacting engagement between said head and said rim, said spacer means comprising a lineal zone beneath said head defining a shank-like neck section of a diameter which exceeds that of said threaded section and which is less than that of said through holes in said housing, said neck section having a height exceeding a transverse through thickness dimension of said rim, positioning of said fastener means through each of said holes in said rim and threadedly engaging said shank within said threaded bores being effective to secure said rim to said housing, and said neck section being operative to preclude bottoming of said head of said fastener means on said rim, and to prevent impression of damaging compressive, stress-generating forces against said rim of said diffuser.

6. The structure as set forth in claim 5 and further comprising compressible washer means circumscribing and carried by said fastener means and interposed between said head and said housing to restrict overtorquing and for obviating application of excessive compression forces to said rim upon securement thereof to said housing.

7. The structure as set forth in claim 6 wherein said washer means are positioned immediately above and immediately beneath said rim as pressure-relieving cushions therefor.

8. The structure as set forth in claim 7 and further comprising retainer ring means carried by said shank of said fastener means adjacent an end of said neck section remote from said head of said fastener means for locking said fastener means onto said rim of said diffuser to prevent inadvertent decoupling of said fastener means from said rim of said diffuser.

9. The structure as set forth in claim 5 and further comprising skirt means integrally formed with and depending from said rim as a protection from an outer edge thereof for sealing said diffuser against said housing of said electrical lighting fixture.

10. The structure as set forth in claim 9 wherein said housing includes at an end thereof presented to said diffuser a perimetric wall circumscribing said skirt means of said diffuser, said wall being formed with radially inwardly directed shoulder means opposed to a downwardly directed end face of said skirt means for supporting gasket-like compressible sealing means interposed between said skirt means and said housing for deterring transmission of fluid from ambient atmosphere to an interior cavity bounded by said diffuser.

11. The structure as set forth in claim 10 wherein said sealing means is a gasket coextensive with said skirt means and abutting an end face thereof and said shoulder means of said housing to seal said skirt means with respect to said housing.

12. The structure as set forth in claim 5 and further comprising reflector means for said lighting fixture to reflect light outwardly thereof and through said diffuser.

13. The structure as set forth in claim 12 including attachment means for maintaining said reflector means secured in place.

14. The structure as set forth in claim 13 wherein said attachment means comprises said fastener means securing said diffuser to said lamp housing.

15. The structure as set forth in claim 1 wherein said fluted, light-dispersing pattern is formed on an under surface of said sides of said diffuser.

16. The structure as set forth in claim 1 wherein each of said sides of said pyramid includes a longitudinally extending center line, and wherein said light dispersing pattern on each of said sides of said truncated pyramid includes an array of laterally-spaced, light-diffusing zones arranged symmetrically with respect to said vertically extending center line of each of said sides of said pyramid, and wherein each of said zones is characterized by longitudinally-extending, parallel, prism-like ribs of a particular radius of transverse curvature, and flutes in alternating sequence with said ribs.

17. The structure as set forth in claim 16 wherein said light diffusing zones comprise a plurality of prism arrays disposed lineally along a lateral expanse of each of said sides of said pyramid, said arrays including sequential incremental steps characterized by parallelly disposed prisms having predetermined particular radii of transverse curvature.

18. The structure as set forth in claim 17 wherein said arrays define prisms exhibiting increasing radii of curvature correlated with increased lateral displacement of said arrays with respect to said vertically-extending center line of each of said sides of said pyramid.

19. The structure as set forth in claim 16 wherein said flutes on each of said sides of said pyramid have a fixed periodicity along a lateral expanse of each of said sides.

20. The structure as set forth in claim 1 wherein said cap includes four generally triangular panels, each of said panels having an apex portion and a base edge thereopposed, said panels being joined to one another at abutting side edges thereof, and wherein each of said panels is formed on an interior face thereof with a dual array of elongated prisms in alternating sequential combination with fluted channels, said prisms of said dual arrays in each of said panels being angled to converge and to intersect along a centerline of each of said panels extending from said apex portion to said base edge of each of said panels.

21. The structure as set forth in claim 20 wherein said prisms of each of said arrays are spaced laterally of one another with fixed periodicity.

22. An inverted, generally pyramidal, molded plastic, light-distributing diffuser including flange means for attaching said diffuser to a lamp housing of an electrical lighting fixture, said flange means comprising a circumambient rim framing said diffuser and extending in a plane generally normal of an axis thereof, said rim being formed with a plurality of through, transverse holes spaced peripherally about said rim, fastener means for securing said diffuser to said housing, said housing being formed with threaded bores extending into said housing and generally normally of said rim, said fastener means comprising an elongated shaft including a threaded section for mating within said threaded bores in said housing, a radially enlarged head surmounting said shaft, spacer means for preventing direct contacting engagement between said head and said rim, said spacer means comprising a lineal zone beneath said head defining a shank-like neck section of a diameter which exceeds that of said threaded section and which is less than that of said through holes in said housing, said neck section having a height exceeding a transverse through thickness dimension of said rim, positioning of said fastener means through each of said holes in said rim and threadedly engaging said shank within said threaded bores being effective to secure said rim to said housing, and said neck section being operative to preclude bottoming of said head of said fastener means on said rim, and to prevent impression of damaging compressive, stress-generating forces against said rim of said diffuser.

23. The structure as set forth in claim 22 and further comprising compressible washer means circumscribing and carried by said fastener means and interposed between said head and said housing to restrict overtorqueing and for obviating application of excessive compression forces to said rim upon securement thereof to said housing.

24. The structure as set forth in claim 22 and further comprising skirt means integrally formed with and depending from said rim as a projection from an outer edge thereof for sealing said diffuser against said housing of said electrical lighting fixture.

25. The structure as set forth in claim 24 wherein said housing includes at an end thereof presented to said diffuser a perimetric wall circumscribing said skirt means of said diffuser, said wall being formed with radially inwardly directed shoulder means opposed to a downwardly directed end face of said skirt means for supporting gasket-like compressible sealing means interposed between said skirt means and said housing for deterring transmission of fluid from ambient atmosphere to an interior cavity bounded by said diffuser.

* * * * *